US012350537B2

(12) United States Patent
Tzavaras

(10) Patent No.: US 12,350,537 B2
(45) Date of Patent: Jul. 8, 2025

(54) MAGNETIC RESISTANCE SPIN POD UPPER BODY EXERCISE FRAME

(71) Applicant: Kosta Tzavaras, Thousand Oaks, CA (US)

(72) Inventor: Kosta Tzavaras, Thousand Oaks, CA (US)

( * ) Notice: Subject to any disclaimer, the term of this patent is extended or adjusted under 35 U.S.C. 154(b) by 201 days.

(21) Appl. No.: 18/320,846

(22) Filed: May 19, 2023

(65) Prior Publication Data

US 2023/0381568 A1 Nov. 30, 2023

Related U.S. Application Data

(60) Provisional application No. 63/346,762, filed on May 27, 2022.

(51) Int. Cl.
*A63B 21/00* (2006.01)
*A63B 21/16* (2006.01)

(52) U.S. Cl.
CPC ..... *A63B 21/00192* (2013.01); *A63B 21/16* (2013.01); *A63B 21/4035* (2015.10); *A63B 21/4049* (2015.10)

(58) Field of Classification Search
CPC ..... A63B 21/00192; A63B 21/16; A63B 21/4035; A63B 21/4049; A63B 2210/50; A63B 22/0005; A63B 22/0694; A63B 21/005; A63B 2225/093
See application file for complete search history.

(56) References Cited

U.S. PATENT DOCUMENTS 1,909,002 A * 5/1933 Oehlberg ..... A63B 22/0007 601/36
4,717,146 A * 1/1988 Nohara ..... A63B 21/00178 601/36
4,934,692 A 6/1990 Owens
5,338,272 A * 8/1994 Sweeney, III ..... B62M 1/12 74/594.1
5,580,338 A * 12/1996 Scelta ..... A63B 22/0605 482/114
5,989,162 A * 11/1999 Daniels ..... A63B 22/0694 482/62
6,960,155 B2 * 11/2005 Chien ..... A63B 22/0005 482/62
7,625,318 B1 * 12/2009 Heyn ..... A63B 21/15 482/100
9,592,421 B2 * 3/2017 Eder ..... A63B 23/12
(Continued)

FOREIGN PATENT DOCUMENTS

KR 20060024296 A 3/2006

*Primary Examiner* — Andrew S Lo

(57) ABSTRACT

The present invention is a cylindrical structure with an electronic display, tension control knob and adjustable frame. The electronic display is installed on the lower portion of the surface and may display a timer, a stopwatch, or a clock based on the user's choice. The tension control knob is installed to allow the user to adjust the intensity of the exercise by turning the knob. The handles are a hand handle that provides a pole structure with a lever connecting pole. The pole structured handle provides an ergonomic design that allows the handles to rotate simultaneously. The resistance pod can be adjusted to a desired height and position along the frame of the present invention to accommodate various heights and gym layouts.

20 Claims, 4 Drawing Sheets

(56) References Cited

U.S. PATENT DOCUMENTS

| | | | | |
|---|---|---|---|---|
| 10,016,651 | B2 * | 7/2018 | Lee | A63B 21/015 |
| 11,298,284 | B2 * | 4/2022 | Bayerlein | A63B 21/00178 |
| 11,534,658 | B2 * | 12/2022 | Tseng | A63B 22/0694 |
| 11,872,431 | B1 * | 1/2024 | Liu | A63B 23/1218 |
| 12,029,937 | B2 * | 7/2024 | Hall | A63B 22/0005 |
| 2004/0198563 | A1 * | 10/2004 | Howell | A63B 22/0005 482/62 |
| 2007/0010375 | A1 * | 1/2007 | Corte | A63B 1/00 482/41 |
| 2007/0129219 | A1 * | 6/2007 | Mahlberg | A61H 1/0237 482/57 |
| 2008/0085819 | A1 * | 4/2008 | Yang | A63B 22/0605 482/57 |
| 2017/0291061 | A1 | 10/2017 | Lee | |
| 2020/0171345 | A1 | 6/2020 | Gonzalez | |
| 2020/0368574 | A1 * | 11/2020 | Bissonnette | A63B 21/0023 |
| 2021/0138304 | A1 | 5/2021 | Mason et al. | |
| 2022/0072362 | A1 * | 3/2022 | Hopson | A63B 21/4035 |
| 2022/0266088 | A1 * | 8/2022 | Hansen | A63B 22/0012 |

* cited by examiner

MAGNETIC RESISTANCE SPIN POD UPPER BODY EXERCISE FRAME

FIELD OF THE INVENTION

The present invention relates generally to a magnetic spinning exercise machine. More specifically, the present invention is a magnetic resistance exercise machine that provides various handles and a mountable frame.

BACKGROUND OF THE INVENTION

A magnetic-resistance hand-spinning machine is configured for upper-body workouts using magnetic resistance technology. Similar to bicycle pedals, it works by rotating handles. Magnetic resistance technology allows adjusting the level of intensity of the exercise. The magnetic-resistance hand-spinning machine is designed to provide targeted workouts to critical areas of the body to enhance muscle toning, lose weight around the waist and chest areas, and restore lost function for rehabilitation purposes.

An objective of the present invention is to provide the magnetic-resistance hand-spinning machine that can be mounted on its flat side parallelly or along its long side vertically. The machine can be surface mounted in a fixed position or adjustable sliding position on a perforated metal rail using an adopter, or an adjustable-height tower (rack). The surface-mounted position of the machine provides a single handle configuration while the vertical mount position provides a double handle configuration. Relative to the machine's position and a user, the machine produces circular arm motion in a variety of directions, parallel or perpendicular to the user's body. Further, the present invention provides various handles such as a ball handle and a hand handle. Additional features and benefits are further discussed in the sections below.

DETAIL DESCRIPTIONS OF THE INVENTION

All illustrations of the drawings are for the purpose of describing selected versions of the present invention and are not intended to limit the scope of the present invention.

The present invention magnetic-resistance hand-spinning machine that is configured for upper-body workouts using magnetic resistance technology. Similar to bicycle pedals, a user can rotate handles of the present invention in circular motions using hands to enhance muscle toning, lose weight around the waist and chest areas, and restore lost function for rehabilitation purposes. Magnetic resistance technology allows adjusting the level of intensity of the exercise. The present invention can be surface mounted in a fixed position or adjustable sliding position on a perforated metal rail using an adopter, or an mechanically adjustable-height tower (rack). The base connector is a bracket that can be attached to the universal connector using nuts and bolts or any desired fasteners. The universal connector can be attached to a wall-mount plate, a track slide adopter, or an exercise rack adopter.

Figure 1:
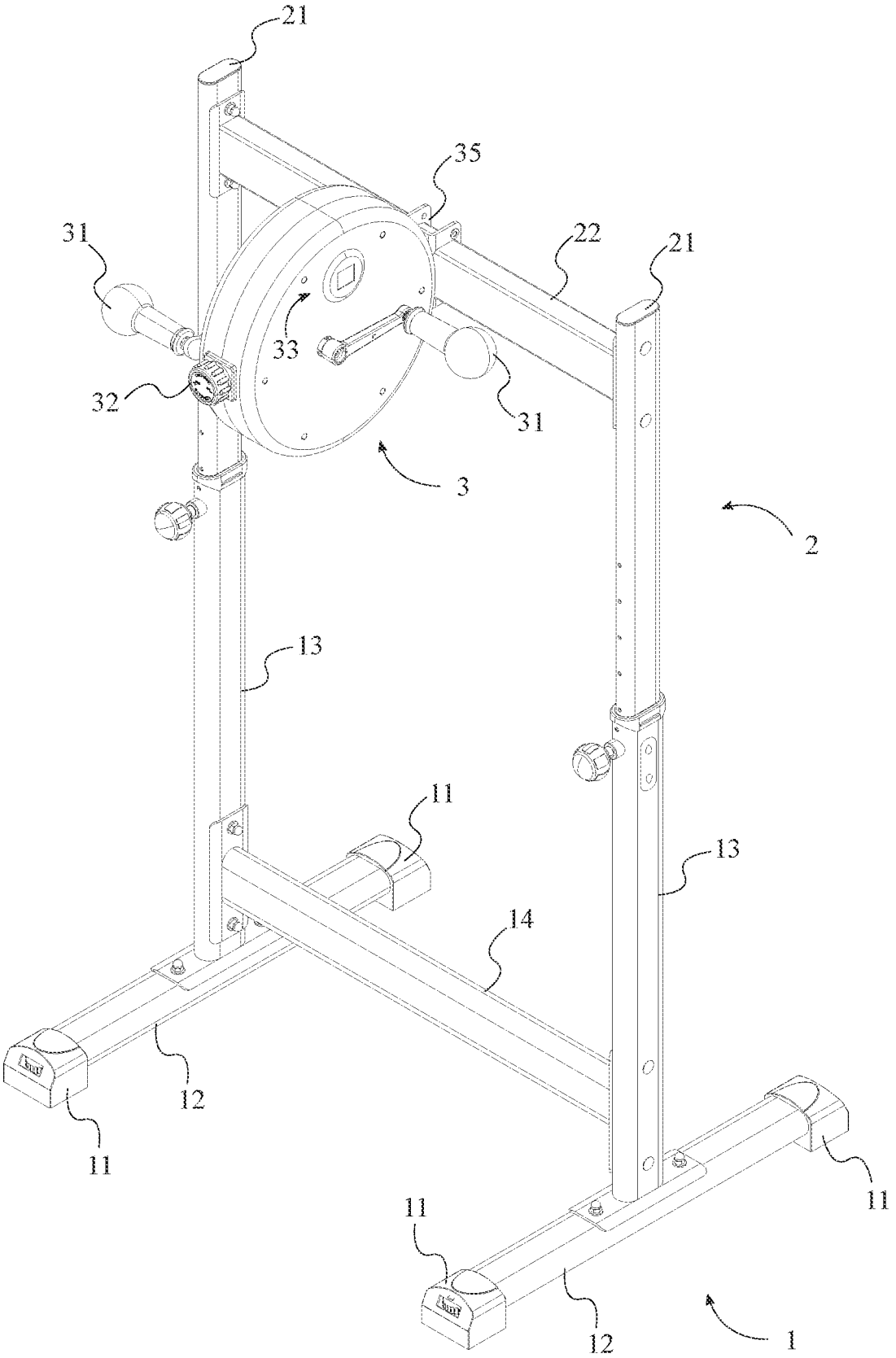
FIG. 1 is a perspective view of the present invention.

In reference to FIG. 1, the present invention is a magnetic resistance spin pod upper body exercise frame comprising a lower frame 1, an upper frame 2, and a resistance pod 3. The lower frame 1 is a metal structure that supports the present invention. The upper frame 2 is a metal structure that fits into the lower frame 1. The resistance pod 3 is a circular device that provides a resistance that burns calories when rotated. The lower frame 1 comprises a plurality of feet 11, a plurality of horizontal base supports 12, a plurality of vertical base supports 13, and a base support connector 14. The upper frame 2 comprises a plurality of extending frames 21 and an extending frame connector rail 22. The resistance pod 3 comprises a plurality of handles 31, a resistance knob 32, a display 33, a plurality of magnets 34, and an upper frame connection 35. The lower frame 1 is secured to the upper frame 2. As a result, the lower frame 1 and upper frame 2 provide structural support for the present invention. The upper frame 2 extends upwards away from the lower frame 1. Consequently, the lower frame 1 and upper frame 2 create a rectangular shape as seen from the front in FIG. 2. The upper frame 2 is movably connected to the lower frame 1 limited to one degree of motion. Accordingly, the upper frame 2 can move upwards and downwards while connected to the lower frame 1. The resistance pod 3 is secured to the upper frame 2. Thus, the resistance pod 3 is adjusted in height along with the upper frame 2. The resistance pod 3 moves horizontally along the upper frame 2. So, the resistance pod 3 can be adjusted in position in two degrees of motion with respect to the upper frame 2 and lower frame 1. The resistance pod 3 extends outwards perpendicularly from the upper frame 2. As a result, the resistance pod 3 is positioned away from the upper frame 2 to prevent interference as the resistance pod 3 is utilized.

In reference to FIG. 1, the plurality of feet 11 is terminally secured to the plurality of horizontal base supports 12. The plurality of feet 11 is designed with a sturdy material with a soft surface designed to grip the surface positioned below. Consequently, the plurality of feet 11 provides the present invention with four support areas with grip to ensure the present invention stays positioned as desired. The plurality of horizontal base supports 12 is positioned parallel to each other. The plurality of horizontal base supports 12 is a long rectangular shaped member. Accordingly, the plurality of horizontal base supports 12 connects the plurality of feet 11 to create a base with two spaced lines. The plurality of vertical base supports 13 secures perpendicularly to the plurality of horizontal supports. The plurality of vertical base supports 13 is a long rectangular shaped member. Thus, the plurality of vertical base supports 13 provides a supporting structure that extends upwards. The plurality of vertical base supports 13 creates an upside-down T-shape with the plurality of vertical base supports 13. The plurality of vertical base supports 13 secures terminally to the base support connector 14. So, the base support connector 14 holds the two vertical base supports together to connect all the components of the lower base into one structure. The plurality of vertical base supports 13 is a hollow structure with a curved rectangular cross-sectional shape. As a result, the plurality of vertical base supports 13 can receive a structure due to the hollow structure and cross-sectional shape.

Figure 2:
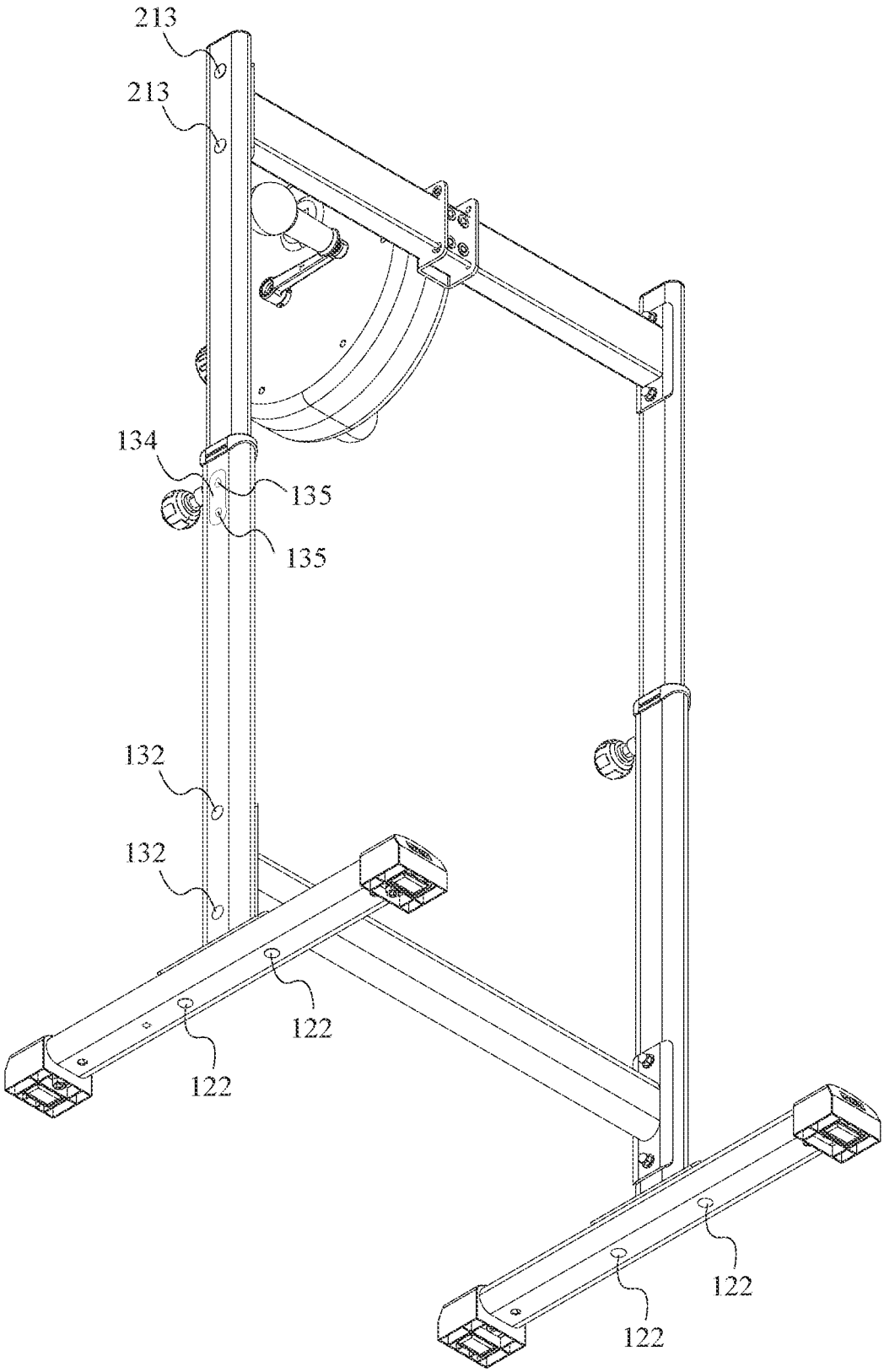
FIG. 2 is a perspective view of the present invention.

Further, as shown in FIG. 2, the plurality of feet 11 is a rectangular box shape. Consequently, the plurality of feet 11 flat provides a large amount of surface to contact the ground below with the flat side of the rectangular box shape. The plurality of feet 11 is a hollow structure with one open face. Accordingly, the plurality of feet 11 holds fits around the plurality of horizontal base supports 12 creating a level base. The plurality of feet 11 secures around the terminal ends of the plurality of horizontal base supports 12. The plurality of horizontal base supports 12 comprises a plurality of horizontal base support bolts 121 and a plurality of horizontal base support holes 122. The plurality of vertical base supports 13 comprises a plurality of vertical base support bolts 131, a plurality of vertical base support holes 132, a securing knobs 133, and a motorized system 134. The securing knobs 133 is a threaded circular knob that tightens and loosens to lock in the upper frame 2 within the lower frame 1. The motorized system 134 is an electrical mechanism that automatically assists lifts and lowers the upper frame 2 within the lower frame 1 as desired. The motorized system 134 further comprising a plurality of buttons 135. The plurality of buttons 135 controls the direction the upper frame moves with respect to the lower frame. As a result, the two buttons of the plurality of buttons can move the upper frame upwards and downwards when pressed.

Furthermore, as shown in FIG. 2, the plurality of horizontal base support holes 122 traverses vertically through the surface of the plurality of horizontal base supports 12. The plurality of horizontal base support holes 122 is a circular shaped hole with a threaded inner wall. Thus, the plurality of base support holes creates an opening on the top surface of the plurality of horizontal base support holes 122. The plurality of horizontal base support holes 122 is positioned equidistant from the midpoint length of the plurality of horizontal base supports 12. So, the plurality of horizontal base support holes 122 is centered along the plurality of horizontal base supports. The plurality of horizontal base support bolts 121 fastens within the plurality of horizontal base support holes 122. As a result, the plurality of horizontal base support bolts 121 is tightened within the plurality of horizontal base support holes 122 by rotating. The plurality of horizontal base support bolts 121 secures the plurality of vertical base supports 13 to the plurality of horizontal base supports 12 Consequently, the plurality of vertical base supports 13 is positioned centrally along the plurality of base supports creating a T-shape as seen from the side.

In reference to FIG. 2, the plurality of vertical base support holes 132 traverses horizontally through the plurality of vertical base supports 13. The plurality of base support holes is a circular shaped hole with a threaded inner wall. Accordingly, the plurality of vertical base support holes 132 creates an opening on both sides of the plurality of vertical base supports 13. The plurality of vertical base support holes 132 is positioned along the lower terminal end of the plurality of vertical base supports 13. Thus, the plurality of vertical base support holes 132 is close to the end positioned near the plurality of horizontal base supports 12. The plurality of vertical base support bolts 131 fastens within the plurality of vertical base support holes 132. So, the plurality of vertical base support bolts 131 is tightened within the plurality of horizontal base support holes 122 by rotating. The plurality of vertical base support bolts 131 secures the base support connector 14 to the plurality of vertical base supports 13. As a result, the plurality of vertical base supports 13 is connected and supported along the bottom creating the lower frame 1 structure.

Figure 3:
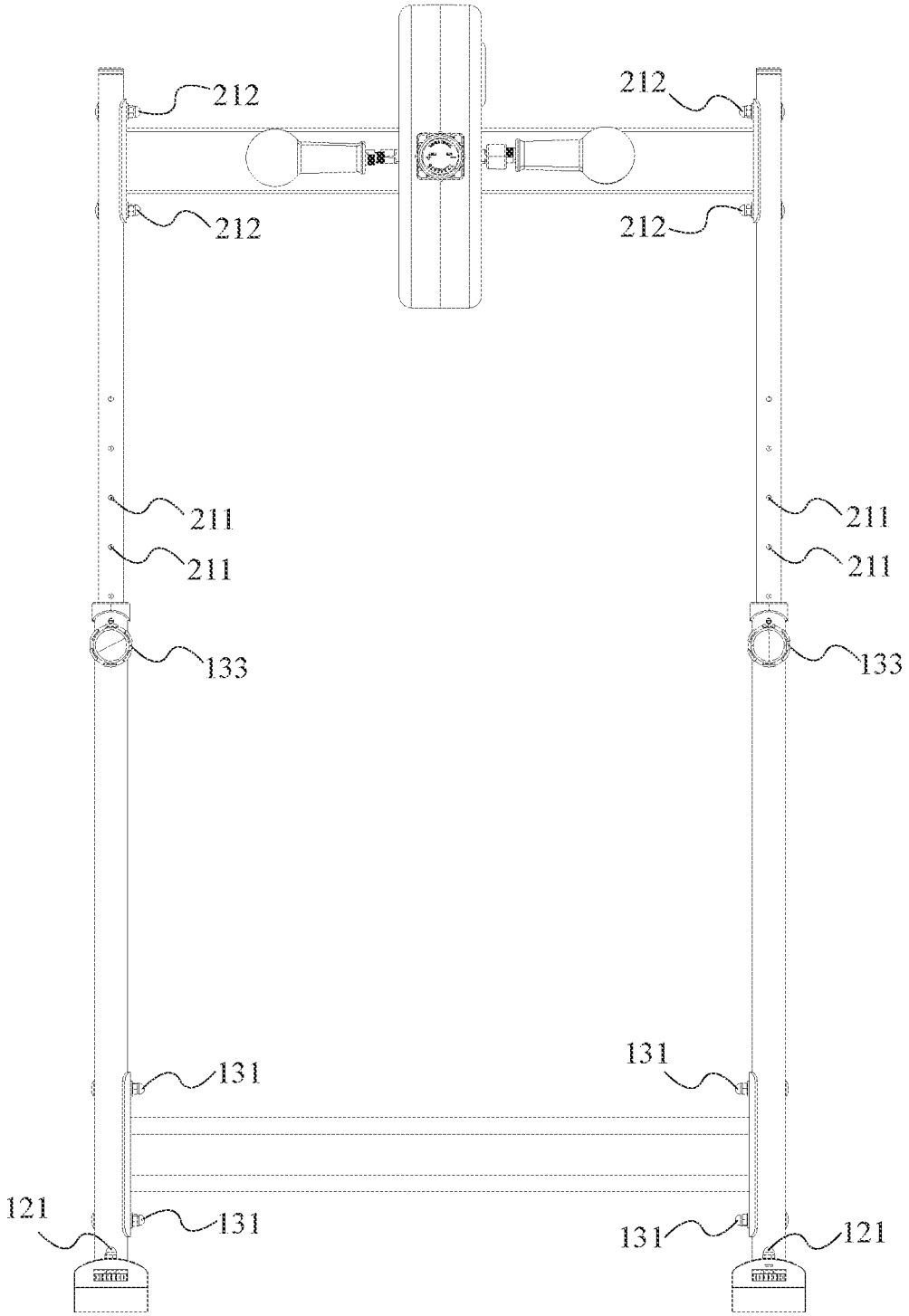
FIG. 3 is a front view of the present invention.

In reference to FIG. 3, the securing knobs 133 extends perpendicularly from the plurality of vertical base supports 13. The securing knobs 133 is parallel with the plurality of horizontal base supports 12. Consequently, the securing knobs 133 creates a right angle with the plurality of vertical base supports 13 allowing it to move in and out of the plurality of vertical base supports 13 perpendicularly. The securing knobs 133 rotates clockwise to create a support force on the upper frame 2. The securing knobs 133 rotates clockwise to release the support force on the upper frame 2. Accordingly, the securing knobs 133 rotates to move inwards or outwards of the plurality of vertical base supports 13 creating and releasing a supporting force on a member positioned within the plurality of vertical base supports 13. The securing knobs 133 is a cylindrical shape. Thus, the cylindrical shape can be turned in place easily.

In reference to FIG. 2, the motorized system 134 mechanically moves the upper frame 2 upwards with respect to the lower frame 1. So, the motorized system 134 utilizes a motor and gear system to raise the upper frame 2 to adjust the upper frame 2 to a desired height by providing power to the motor to create a torque force. The motorized system 134 mechanically moves the upper frame 2 downwards with respect to the lower frame 1. As a result, the motorizes system lowers the upper frame 2 by providing power to the motor to create a torque force in the opposite direction of the torque force used to raise the upper frame 2.

In reference to FIG. 2, the plurality of extending frames 21 is a similar structure with a similar curved rectangular cross-section as the hollow structure of the plurality of vertical base supports 13. The plurality of extending frames 21 is a long rectangular shaped member. The plurality of extending frames 21 fits within the plurality of vertical base supports 13. Consequently, the plurality of extending frames 21 moves within the plurality of vertical base supports 13 with one degree of freedom. The plurality of extending frames 21 mechanically moves up and down within the plurality of vertical base supports 13. Accordingly, the plurality of extending frames 21 is mechanically connected to the motorized system 134. The plurality of extending frames 21 secures terminally to the extending frame connector rail 22. Thus, the plurality of extending frames 21 creates an upside-down bracket shape with the extending frame connector rail 22. The plurality of extending frames 21 comprises a plurality of level holes 211, a plurality of frame bolts, and a plurality of extending frame holes 213.

Further, as shown in FIG. 3, the plurality of level holes 211 traverses horizontally through the plurality of extending frames 21. The plurality of level holes 211 is a circular hole that creates an opening on the front and rear sides of the plurality of extending frames 21. So, the plurality of level holes 211 creates a variety of heights the upper frame 2 can be set to. The plurality of level holes 211 is positioned along the bottom half of the plurality of extending frames 21. As a result, the plurality of extending frames 21 can be positioned at the fully extended range or lowered around halfway extended. The plurality of level holes 211 is positioned equally along the plurality of extending frames 21. Consequently, the upper frame 2 is positioned at various heights with each height level the same distance apart. The plurality of level holes 211 receives a support force from the securing knobs 133. The securing knobs 133 tightens and loosens to lock into the plurality of level holes 211 to hold the upper frame 2 at the desired height.

Furthermore, as shown in FIG. 3, the plurality of extending frame holes 213 traverses horizontally through the plurality of extending frames 21. The plurality of extending frame holes 213 is circular shaped with a threaded inner wall. Accordingly, the plurality of extending frame holes 213 creates an opening on both sides of the plurality of extending frames 21. The plurality of extending frame holes 213 traverses through the plurality of extending frames 21 perpendicular to the plurality of level holes 211. Thus, the plurality of extending frame holes 213 is positioned on the wider sides of the plurality of extending frames 21. The plurality of extending frame holes 213 is positioned terminally along the plurality of extending frames 21 opposite the plurality of level holes 211. So, the plurality of extending frame holes 213 does not interfere with the plurality of level holes 211. The plurality of extending frame bolts 212 fastens within the plurality of extending frame holes 213. As a result, the plurality of extending frame bolts 212 is tightened within the plurality of extending frame holes 213 by rotating. The plurality of extending frame bolts 212 secures the extending frame connector rail 22 to the plurality of extending frames 21. Consequently, the extending frame connector rail 22 creates an upper connection between the plurality of extending frames 21 on either end.

Figure 4:
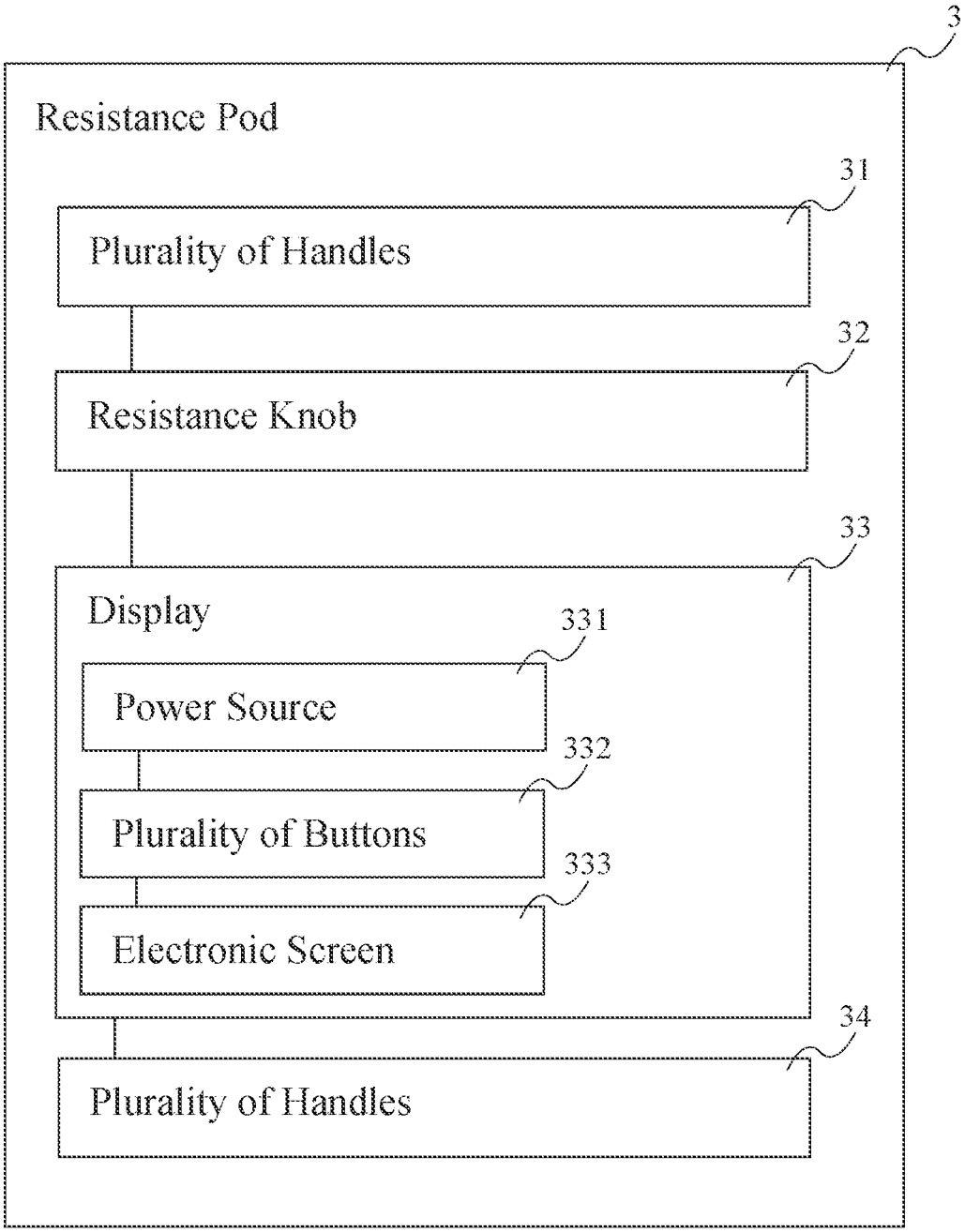
FIG. 4 is a block diagram illustration of the present invention.

In reference to FIG. 4, the resistance pod 3 is a circular shape. The resistance pod 3 is a short cylindrical housing that houses various mechanical components and magnetic components to create a resistive force. The plurality of handles 31 is rotatably secured to the resistance pod 3. Accordingly, the plurality of handles 31 moves in a circular motion around a central axis on the surface of the resistance pod 3. The plurality of handles 31 rotates simultaneously. Thus, the plurality of handles 31 equally distributes the resistive force when rotated, causing each handle to move in conjunction with the other handle, mechanically connected at the pivot point of each handle. The plurality of handles 31 is mechanically coupled to the plurality of magnets 34. So, the plurality of magnets 34 creates a resistive force on the plurality of handles 31 as the plurality of handles 31 is rotated. The plurality of magnets 34 is positioned within the resistance pod 3.

Further, as shown in FIG. 1, the resistance knob 32 is a cylindrical structure. The resistance knob 32 controls the amount of resistance created by the plurality of magnets 34. The resistance knob 32 is secured to the resistance pod 3. As a result, the resistance knob 32 is easily accessible. The resistance knob 32 rotates along the central axis of the resistance knob 32. Consequently, the resistance knob 32 rotates clockwise and counterclockwise while staying in place along the resistance pod 3. The resistance knob 32 adjusts the plurality of magnets 34. Accordingly, the resistance knob 32 controls the amount of resistance force created by the plurality of magnets 34 when the resistance knob 32 is rotated.

Further, as shown in FIG. 1, the upper frame connection 35 secures the resistance pod 3 to the extending frame connector rail 22. The upper frame connection 35 is a bracket shaped clamp creates a tension to hold onto the extending frame connector rail 22 without restricting horizontal motion along the extending frame connector rail 22. The upper frame connection 35 slides horizontally along the extending frame connector rail 22. Thus, the resistance pod 3 can be adjusted horizontally along the upper frame 2.

Further, as shown in FIG. 4, the display 33 is a rectangular shape. The display 33 is an electronic device that computes and displays information. The display 33 comprises a power source 331, a plurality of buttons 332, and an electronic screen 333. The power source 331, the plurality of buttons 332, and the electronic screen 333 is electrically connected. The electronic screen 333 is electronically connected to the plurality of magnets 34, plurality of handles 31, and resistance knob 32. So, the electronic screen 333 can receive information from the plurality of magnets 34, plurality of handles 31, and resistance knob 32 to calculate the amount of resistance force currently being created, the speed the plurality of handles 31 are being rotated, and the level of difficulty currently engaged. The electronic screen 333 monitoring the plurality of magnets 34, plurality of handles 31, and the resistance knob 32. The electronic screen 333 displays the information that is seen from outside of the resistance pod 3.

Although the invention has been explained in relation to its preferred embodiment, it is to be understood that many other possible modifications and variations can be made without departing from the spirit and scope of the invention as hereinafter claimed.

What is claimed is:

1. A magnetic resistance spin pod upper body exercise frame comprising:

a lower frame;

an upper frame;

a resistance pod;

the lower frame comprising a plurality of feet, a plurality of horizontal base supports, a plurality of vertical base supports, and a base support connector;

the upper frame comprising a plurality of extending frames and an extending frame connector rail;

the resistance pod comprising a plurality of handles, a resistance knob, a display, a plurality of magnets, and an upper frame connection;

the lower frame being secured to the upper frame;

the upper frame extending upwards away from the lower frame;

the upper frame being movably connected to the lower frame limited to one degree of motion;

the resistance pod being secured to the upper frame;

the resistance pod moving horizontally along the upper frame; and the resistance pod extending outwards perpendicularly from the upper frame.

2. The present invention as claimed in claim 1 comprising:

the plurality of feet being terminally secured to the plurality of horizontal base supports;

the plurality of horizontal base supports being positioned parallel to each other;

the plurality of vertical base supports securing perpendicularly to the plurality of horizontal supports;

the plurality of vertical base supports creating an upside-down T-shape with the plurality of vertical base supports;

the plurality of vertical base supports securing terminally to the base support connector; and the plurality of vertical base supports being a hollow structure with a curved rectangular cross-sectional shape.

3. The present invention as claimed in claim 2 comprising:

the plurality of feet being a rectangular box shape;

the plurality of feet being a hollow structure with one open face;

the plurality of feet securing around the terminal ends of the plurality of horizontal base supports;

the plurality of horizontal base supports comprising a plurality of horizontal base support bolts and a plurality of horizontal base support holes; and the plurality of vertical base supports comprising a plurality of vertical base support bolts, a plurality of vertical base support holes, a securing knob, and a motorized system.

4. The present invention as claimed in claim 3 comprising:

the plurality of horizontal base support holes traversing vertically through the surface of the plurality of horizontal base supports;

the plurality of horizontal base support holes being positioned equidistant from the midpoint length of the plurality of horizontal base supports;

the plurality of horizontal base support bolts fastening within the plurality of horizontal base support holes; and the plurality of horizontal base support bolts securing the plurality of vertical base supports to the plurality of horizontal base supports.

5. The present invention as claimed in claim 3 comprising:

the plurality of vertical base support holes traversing horizontally through the plurality of vertical base supports;

the plurality of vertical base support holes being positioned along the lower terminal end of the plurality of vertical base supports;

the plurality of vertical base support bolts fastening within the plurality of vertical base support holes; and the plurality of vertical base support bolts securing the base support connector to the plurality of vertical base supports.

6. The present invention as claimed in claim 3 comprising:

the securing knob extending perpendicularly from the plurality of vertical base supports;

the securing knob being parallel with the plurality of horizontal base supports;

the securing knob rotating clockwise to create a support force on the upper frame;

the securing knob rotating clockwise to release the support force on the upper frame; and the securing knob being a cylindrical shape.

7. The present invention as claimed in claim 3 comprising:

the motorized system mechanically moving the upper frame upwards with respect to the lower frame;

the motorized system mechanically moving the upper frame downwards with respect to the lower frame;

the motorized system further comprising a plurality of buttons; and the plurality of buttons controlling the direction the upper frame moves with respect to the lower frame.

8. The present invention as claimed in claim 2 comprising:

the plurality of extending frames being a similar structure with a similar curved rectangular cross-section than the hollow structure of the plurality of vertical base supports;

the plurality of extending frames fitting within the plurality of vertical base supports;

the plurality of extending frames mechanically moving up and down within the plurality of vertical base supports;

the plurality of extending frames securing terminally to the extending frame connector rail; and the plurality of extending frames comprising a plurality of level holes, a plurality of frame bolts, and a plurality of extending frame holes.

9. The present invention as claimed in claim 8 comprising:

the plurality of level holes traversing horizontally through the plurality of extending frames;

the plurality of level holes being positioned along the bottom half of the plurality of extending frames;

the plurality of level holes being positioned equally along the plurality of extending frames; and the plurality of level holes receiving a support force from the securing knob.

10. The present invention as claimed in claim 9 comprising:

the plurality of frame holes traversing horizontally through the plurality of extending frames;

the plurality of frame holes traversing through the plurality of extending frames perpendicular to the plurality of level holes;

the plurality of frame holes being positioned terminally along the plurality of extending frames opposite the plurality of level holes;

the plurality of extending frame bolts fastening within the plurality of extending frame holes; and the plurality of extending frame bolts securing the extending frame connector rail to the plurality of extending frames.

11. The present invention as claimed in claim 1 comprising:

the resistance pod being a circular shape;

the plurality of handles being rotatably secured to the resistance pod;

the plurality of handles rotating simultaneously;

the plurality of handles being mechanically coupled to the plurality of magnets; and the plurality of magnets being positioned within the resistance pod.

12. The present invention as claimed in claim 11 comprising:

the resistance knob being a cylindrical structure;

the resistance knob being secured to the resistance pod;

the resistance knob rotating along the central axis of the resistance knob; and the resistance knob adjusting the plurality of magnets.

13. The present invention as claimed in claim 11 comprising:

the upper frame connection securing the resistance pod to the extending frame connector rail; and the upper frame connection sliding horizontally along the extending frame connector rail.

14. The present invention as claimed in claim 11 comprising:

the display being a rectangular shape;

the display comprising a power source, a plurality of buttons, and an electronic screen;

the power source, the plurality of buttons, and the electronic screen being electrically connected;

the electronic screen being electronically connected to the plurality of magnets, plurality of handles, and resistance knob; and the electronic screen monitoring the plurality of magnets, plurality of handles, and the resistance knob.

15. A magnetic resistance spin pod upper body exercise frame comprising:

a lower frame;

an upper frame:

a resistance pod;

the lower frame comprising a plurality of feet, a plurality of horizontal base supports, a plurality of vertical base supports, and a base support connector;

the upper frame comprising a plurality of extending frames and an extending frame connector rail;

the resistance pod comprising a plurality of handles, a resistance knob, a display, a plurality of magnets, and an upper frame connection;

the lower frame being secured to the upper frame;
the upper frame extending upwards away from the lower frame;
the upper frame being movably connected to the lower frame limited to one degree of motion;
the resistance pod being secured to the upper frame;
the resistance pod moving horizontally along the upper frame;
the resistance pod extending outwards perpendicularly from the upper frame;
the plurality of feet being terminally secured to the plurality of horizontal base supports;
the plurality of horizontal base supports being positioned parallel to each other;
the plurality of vertical base supports securing perpendicularly to the plurality of horizontal supports;
the plurality of vertical base supports creating an upside-down T-shape with the plurality of vertical base supports;
the plurality of vertical base supports securing terminally to the base support connector;
the plurality of vertical base supports being a hollow structure with a curved rectangular cross-sectional shape;
the plurality of feet being a rectangular box shape;
the plurality of feet being a hollow structure with one open face;
the plurality of feet securing around the terminal ends of the plurality of horizontal base supports;
the plurality of horizontal base supports comprising a plurality of horizontal base support bolts and a plurality of horizontal base support holes; and
the plurality of vertical base supports comprising a plurality of vertical base support bolts, a plurality of vertical base support holes, a securing knob, and a motorized system.

16. The present invention as claimed in claim 15 comprising:
the plurality of horizontal base support holes traversing vertically through the surface of the plurality of horizontal base supports;
the plurality of horizontal base support holes being positioned equidistant from the midpoint length of the plurality of horizontal base supports;
the plurality of horizontal base support bolts fastening within the plurality of horizontal base support holes;
the plurality of horizontal base support bolts securing the plurality of vertical base supports to the plurality of horizontal base supports;
the plurality of vertical base support holes traversing horizontally through the plurality of vertical base supports;
the plurality of vertical base support holes being positioned along the lower terminal end of the plurality of vertical base supports;
the plurality of vertical base support bolts fastening within the plurality of vertical base support holes;
the plurality of vertical base support bolts securing the base support connector to the plurality of vertical base supports;
the securing knob extending perpendicularly from the plurality of vertical base supports;
the securing knob being parallel with the plurality of horizontal base supports;
the securing knob rotating clockwise to create a support force on the upper frame;
the securing knob rotating clockwise to release the support force on the upper frame;
the securing knob being a cylindrical shape;
the motorized system mechanically moving the upper frame upwards with respect to the lower frame;
the motorized system mechanically moving the upper frame downwards with respect to the lower frame;
the motorized system further comprising a plurality of buttons;
the plurality of buttons controlling the direction the upper frame moves with respect to the lower frame.

17. The present invention as claimed in claim 15 comprising:
the plurality of extending frames being a similar structure with a similar curved rectangular cross-section than the hollow structure of the plurality of vertical base supports;
the plurality of extending frames fitting within the plurality of vertical base supports;
the plurality of extending frames mechanically moving up and down within the plurality of vertical base supports;
the plurality of extending frames securing terminally to the extending frame connector rail;
the plurality of extending frames comprising a plurality of level holes, a plurality of frame bolts, and a plurality of extending frame holes;
the plurality of level holes traversing horizontally through the plurality of extending frames;
the plurality of level holes being positioned along the bottom half of the plurality of extending frames;
the plurality of level holes being positioned equally along the plurality of extending frames;
the plurality of level holes receiving a support force from the securing knob;
the plurality of frame holes traversing horizontally through the plurality of extending frames;
the plurality of frame holes traversing through the plurality of extending frames perpendicular to the plurality of level holes;
the plurality of frame holes being positioned terminally along the plurality of extending frames opposite the plurality of level holes;
the plurality of extending frame bolts fastening within the plurality of extending frame holes;
the plurality of extending frame bolts securing the extending frame connector rail to the plurality of extending frames;
the resistance pod being a circular shape;
the plurality of handles being rotatably secured to the resistance pod;
the plurality of handles rotating simultaneously;
the plurality of handles being mechanically coupled to the plurality of magnets;
the plurality of magnets being positioned within the resistance pod;
the resistance knob being a cylindrical structure;
the resistance knob being secured to the resistance pod;
the resistance knob rotating along the central axis of the resistance knob;
the resistance knob adjusting the plurality of magnets;
the upper frame connection securing the resistance pod to the extending frame connector rail;
the upper frame connection sliding horizontally along the extending frame connector rail;
the display being a rectangular shape;
the display comprising a power source, a plurality of buttons, and an electronic screen;

the power source, the plurality of buttons, and the electronic screen being electrically connected;

the electronic screen being electronically connected to the plurality of magnets, plurality of handles, and resistance knob; and the electronic screen monitoring the plurality of magnets, plurality of handles, and the resistance knob.

18. The present invention as claimed in claim 15 comprising:

the resistance pod being a circular shape;

the plurality of handles being rotatably secured to the resistance pod;

the plurality of handles rotating simultaneously;

the plurality of handles being mechanically coupled to the plurality of magnets;

the plurality of magnets being positioned within the resistance pod;

the resistance knob being a cylindrical structure;

the resistance knob being secured to the resistance pod;

the resistance knob rotating along the central axis of the resistance knob;

the resistance knob adjusting the plurality of magnets;

the upper frame connection securing the resistance pod to the extending frame connector rail;

the upper frame connection sliding horizontally along the extending frame connector rail;

the display being a rectangular shape;

the display comprising a power source, a plurality of buttons, and an electronic screen;

the power source, the plurality of buttons, and the electronic screen being electrically connected;

the electronic screen being electronically connected to the plurality of magnets, plurality of handles, and resistance knob; and the electronic screen monitoring the plurality of magnets, plurality of handles, and the resistance knob.

19. A magnetic resistance spin pod upper body exercise frame comprising:

a lower frame;

an upper frame:

a resistance pod;

the lower frame comprising a plurality of feet, a plurality of horizontal base supports, a plurality of vertical base supports, and a base support connector;

the upper frame comprising a plurality of extending frames and an extending frame connector rail;

the resistance pod comprising a plurality of handles, a resistance knob, a display, a plurality of magnets, and an upper frame connection;

the lower frame being secured to the upper frame;

the upper frame extending upwards away from the lower frame;

the upper frame being movably connected to the lower frame limited to one degree of motion;

the resistance pod being secured to the upper frame;

the resistance pod moving horizontally along the upper frame;

the resistance pod extending outwards perpendicularly from the upper frame;

the plurality of feet being terminally secured to the plurality of horizontal base supports;

the plurality of horizontal base supports being positioned parallel to each other;

the plurality of vertical base supports securing perpendicularly to the plurality of horizontal supports;

the plurality of vertical base supports creating an upside-down T-shape with the plurality of vertical base supports;

the plurality of vertical base supports securing terminally to the base support connector;

the plurality of vertical base supports being a hollow structure with a curved rectangular cross-sectional shape;

the plurality of feet being a rectangular box shape;

the plurality of feet being a hollow structure with one open face;

the plurality of feet securing around the terminal ends of the plurality of horizontal base supports;

the plurality of horizontal base supports comprising a plurality of horizontal base support bolts and a plurality of horizontal base support holes;

the plurality of vertical base supports comprising a plurality of vertical base support bolts, a plurality of vertical base support holes, a securing knob, and a motorized system;

the plurality of horizontal base support holes traversing vertically through the surface of the plurality of horizontal base supports;

the plurality of horizontal base support holes being positioned equidistant from the midpoint length of the plurality of horizontal base supports;

the plurality of horizontal base support bolts fastening within the plurality of horizontal base support holes;

the plurality of horizontal base support bolts securing the plurality of vertical base supports to the plurality of horizontal base supports;

the plurality of vertical base support holes traversing horizontally through the plurality of vertical base supports;

the plurality of vertical base support holes being positioned along the lower terminal end of the plurality of vertical base supports;

the plurality of vertical base support bolts fastening within the plurality of vertical base support holes;

the plurality of vertical base support bolts securing the base support connector to the plurality of vertical base supports;

the securing knob extending perpendicularly from the plurality of vertical base supports;

the securing knob being parallel with the plurality of horizontal base supports;

the securing knob rotating clockwise to create a support force on the upper frame;

the securing knob rotating clockwise to release the support force on the upper frame;

the securing knob being a cylindrical shape;

the motorized system mechanically moving the upper frame upwards with respect to the lower frame;

the motorized system mechanically moving the upper frame downwards with respect to the lower frame;

the motorized system further comprising a plurality of buttons; and the plurality of buttons controlling the direction the upper frame moves with respect to the lower frame.

20. The present invention as claimed in claim 19 comprising:

the plurality of extending frames being a similar structure with a similar curved rectangular cross-section than the hollow structure of the plurality of vertical base supports;

the plurality of extending frames fitting within the plurality of vertical base supports;

the plurality of extending frames mechanically moving up and down within the plurality of vertical base supports;

the plurality of extending frames securing terminally to the extending frame connector rail;

the plurality of extending frames comprising a plurality of level holes, a plurality of frame bolts, and a plurality of extending frame holes;

the plurality of level holes traversing horizontally through the plurality of extending frames;

the plurality of level holes being positioned along the bottom half of the plurality of extending frames;

the plurality of level holes being positioned equally along the plurality of extending frames;

the plurality of level holes receiving a support force from the securing knob;

the plurality of frame holes traversing horizontally through the plurality of extending frames;

the plurality of frame holes traversing through the plurality of extending frames perpendicular to the plurality of level holes;

the plurality of frame holes being positioned terminally along the plurality of extending frames opposite the plurality of level holes;

the plurality of extending frame bolts fastening within the plurality of extending frame holes; and the plurality of extending frame bolts securing the extending frame connector rail to the plurality of extending frames.

* * * * *